United States Patent [19]

Schmitt

[11] 3,963,626

[45] June 15, 1976

[54] FIRE EXTINGUISHANT FOR FISSIONABLE MATERIAL

[75] Inventor: Charles R. Schmitt, Oak Ridge, Tenn.

[73] Assignee: The United States of America as represented by the United States Energy Research and Development Administration, Washington, D.C.

[22] Filed: Mar. 22, 1974

[21] Appl. No.: 454,027

Related U.S. Application Data

[63] Continuation-in-part of Ser. No. 356,865, May 3, 1973, Pat. No. 3,938,012.

[52] U.S. Cl. ..... 252/2; 176/38

[51] Int. Cl.[2] ..... A62D 1/00

[58] Field of Search ..... 176/38; 252/2

[56] References Cited

UNITED STATES PATENTS

| | | | |
|---|---|---|---|
| 3,475,332 | 10/1969 | Leeper et al. | 252/2 |
| 3,840,075 | 10/1974 | Schmitt | 252/2 |

*Primary Examiner*—Stephen J. Lechert, Jr.
*Attorney, Agent, or Firm*—Dean E. Carlson; David S. Zachry; John B. Hardaway, III

[57] ABSTRACT

Carbon microspheres impregnated with a neutron poison are used as an extinguishant for radioactive and fissionable metal fires.

9 Claims, No Drawings

FIRE EXTINGUISHANT FOR FISSIONABLE MATERIAL

BACKGROUND OF THE INVENTION

This invention was made in the course of, or under, a contract with the United States Atomic Energy Commission. It relates generally to a method for extinguishing metal fires.

CROSS REFERENCE TO RELATED APPLICATION

This application is a continuation in part of application Ser. No. 356,865 filed May 3, 1973, now U.S. Pat. No. 3,938,012.

Pyrophoric metals present a hazard in many industrial areas. Basically, the pyrophoric metals include the alkali and alkaline earth metals. However, many of the rare earth and actinide metals are also pyrophoric. In nuclear processing facilities, sodium, potassium, uranium, thorium, and zirconium are the metals which present the principal hazards.

Many solid extinguishants are commercially available for extinguishing metal fires. However, not all extinguishants are suitable for all metal fires and others have detrimental side effects. Silica is satisfactory for extinguishing some fires. However, when silica is placed on a burning sodium potassium mixture, it actually reacts with the burning metal to produce a larger fire. Graphite flour and flakes have proven to be an effective means of extinguishing a metal fire. However, the present graphite extinguishants produce great clouds of black dust when projected at a fire. If projected within an enclosure, such as an ordinary room, the air becomes contaminated with finely divided graphite to the extent that sight and respiration are impossible without special equipment. Sodium chloride has also been used to effectively extinguish metal fires. However, sodium chloride is extremely corrosive. Any equipment in the vicinity of the fire is subject to corrosion by the sodium chloride. Phosphate extinguishants have also been used in the prior art. However, these extinguishants also have a dusting problem as well as causing additional smoke to be emitted from the fire.

In using the above extinguishants it is conventional to use a canister filled with the extinguishant and supplied with a source of pressurized gas such as $N_2$ or $CO_2$. The canisters normally communicate with a hose-and-nozzle fitting. In use, the pressurized gas forces the extinguishant out of the canister through the hose-and-nozzle fitting to create a continuous projection of extinguishant. When a solid, such as those described above, is used as the extinguishant, clogging of the hose-and-nozzle assembly in a frequent problem. This problem is particularly acute when the extinguishant is a hygroscopic material. If moisture exists within or leaks into the canister, the hygroscopic material becomes sticky so as to effectively prevent any spraying from the canister at all.

Another problem with some solid extinguishants is that they have a specific gravity which is greater than that of some molten pyrophoric metals. In such cases, the extinguishant is ineffective because the extinguishant merely sinks through the molten metal so as not to separate the metal from the surrounding air.

Special hazards exist for metals which are radioactive and/or fissionable. Fires in radioactive materials present not only the hazards associated with fire but also the hazards associated with airborne contamination.

Fissionable materials present still greater hazards. For example, fires and explosions in fissionable materials could possibly rearrange the geometrical configuration of the material so as to bring about criticality.

SUMMARY OF THE INVENTION

It is thus an object of this invention to provide a new extinguishant for radioactive and fissionable metal fires.

It is a further object of this invention to provide a solid extinguishant which can be projected like a liquid and which does not dust when projected at a fire.

It is a still further object of this invention to provide an essentially inert extinguishant for metal fires which will not increase the amount of smoke given off from the fire.

It is a particular object of this invention to provide an extinguishant for radioactive and fissionable metals which will not only reduce airborne contamination but also eliminate criticality hazards.

These and other objects are accomplished by using carbon microspheres impregnated with a neutron poison as an extinguishant for radioactive and fissionable metal fires.

DETAILED DESCRIPTION

According to this invention it has been found that carbon or graphite microspheres which are impregnated with a neutron poison can be used as an extinguishant for radioactive and fissionable metal fires with none of the disadvantages that adhere in the prior-art use of graphite flour or flakes and with the advantage that airborne contamination and danger of criticality are greatly reduced or eliminated. As is disclosed in copending application Ser. No. 356,865, carbon microspheres can be projected from a conventional powder extinguisher canister with flow and projection qualities that approximate those of a liquid. Since the microspheres have liquid-like flow properties, there is generally no problem with clogging or sticking within the extinguisher canister.

Carbon microspheres have a mass such that, when sprayed through the air, no dusting occurs. The use of the extinguishant of this invention thus makes it possible to extinguish a fire within an enclosure without creating clouds of noxious dust, which in the case of radioactive materials eliminates a large quantity of airborne contamination. By concentrating the extinguishant only on the fire, cleanup problems after the fire are greatly reduced since the surrounding area is not covered with extinguishant. Carbon microspheres are essentially inert so that no additional smoke is created when the microspheres contact the burning metal. Once the fire is extinguished, the metal may be easily recovered since no actual reaction occurs between the microspheres and the metal to produce undesirable contaminants. A simple mechanical separation process may be used to separate the microspheres from the previously burning metal.

Carbon microspheres used in the process of this invention extinguish metal fires by first covering the metal surface and thus separating the metal from an oxygen source, and secondly by conducting heat away from the burning metal. Since carbon is of very low density, it will naturally float on the surface of most metals.

Microspheres for use in the process of this invention have the following characteristics. The microspheres may be within a size range of 50 to 250 microns in radius, but preferably within the range of about 75 to 100 microns. While it is preferred that the microspheres for use in this invention be as nearly spherical as possible, it has been found that microspheres or microspheroids having a major-to-minor-axis ratio of up to about 1.5 are useful in the process of this invention. The microspheres preferably have a free flow density within the range of 0.9 g/cc to 1.4 g/cc and a real particle density or toluene displacement density of 1.3 g/cc to 2.0 g/cc. The internal particle porosity of the microparticles may range from 0.5 to 10.0 percent for use in the process of this invention. Although not a critical characteristic, it has been found that the microparticle compressive strength should be in the range of from 10 to 60 ounces per particle, depending upon particle diameter, so that the particle has sufficient strength to withstand velocity impact foces during projection and not be subject to excessive fracturing. Microspheres for use in the invention preferably have an organic content of less than about 10 percent. A higher organic content can cause water absorption and sticking of the particles.

Microspheres useful in practicing this invention can be prepared by incorporating a neutron absorber into an ion exchange resin which is then coked at a temperature of about 900°C. in an inert atmosphere. The neutron absorber can also be incorporated into resins such as furans, phenolics, and petroleum pitches which are subsequently carbonized and/or graphitized with heat in an inert atmosphere by the method generally described in copending application Ser. No. 195,052 filed Nov. 2, 1971.

The neutron absorber may be selected for specific fissionable materials which have neutron energy spectra within the absorption range of the selected absorber. In addition, a mixture of neutron absorbers such as boron, cadmium, and gadolinium may be incorporated into the microspheres. The microspheres may contain from 0 to about 65 weight percent neutron absorber, depending on the particular hazard which is being guarded against. In certain situations, carbon by itself could serve as a neutron absorber. Of course, in cases where the criticality hazard is more severe, naturally occurring absorbers may be replaced by their more effective isotopes; for instance, boron-10 could be used instead of natural boron.

The amount of neutron absorber present in the final microspheroids also depends on the particular ion exchange resin used in the preparation of the final carbon microspheroids and on the particular loading techniques. The ion exchange resins may be loaded from a small fraction to 100 percent of the theoretical capacity with the particular neutron absorber. The ranges in the table below have been found useful in the final carbon microspheres. Mixtures of neutron absorbers may also be used within the cited ranges.

TABLE

| Neutron Absorber | Effective Range (wt. %) |
|---|---|
| Boron | 0.1 to 11.5 |
| Cadmium | 0.1 to 62 |
| Gadolinium | 0.1 to 57 |

While this invention has been described in terms of carbon or graphite microspheroids impregnated with a neutron absorber, for the purposes of this invention it makes no difference whether the microspheroids are carbon or graphite. Accordingly, the term carbon is used in the appended claims in a generic sense to include both amorphous carbon and graphite. Amorphous carbon is generally formed by heating appropriately impregnated resin beads in an inert atmosphere to about 800° to 900° C., whereas graphite is formed by heating the impregnated resin beads in an inert atmosphere to a temperature of about 2700° to 3000° C.

A conventional powder canister is suitable for use in this invention. A cartridge-type extinguisher as illustrated in *Fire Protection Handbook*, 13th Edition (1969), G. H. Tryon, editor, pages 18–36, is the preferred extinguisher. It has also been found desirable to modify this type of extinguisher by providing a gate valve between the $CO_2$ cartridge and the chamber so that the pressure buildup may be relieved in the event of blockage.

Having generally described the extinguishant of this invention, the following specific examples are given as a further aid to the understanding thereof.

EXAMPLE I

Boron-loaded carbon microspheres were made by dissolving boron trioxide, $B_2O_3$, in a 1:2 by volume mixture of acetone and polyfurfuryl alcohol prepolymer resin. Approximately 2 wt. percent of maleic anhydride was added as a polymerization catalyst and the mixture was converted to resin microspheres using a vibrating bar apparatus and technique as has been described previously in *Nuclear Technology*, Vol. 11, May 1971, pages 29–37. The boron-loaded resin microspheres were oven-cured at 65°C. and carbonized by slowly heating to 900°C. in a non-oxidizing, flowing nitrogen atmosphere over a sixty-hour heating cycle. After coking, the boron-loaded microspheres analyzed 11.5 percent boron.

Boron-loaded carbon microspheres may also be prepared by the treatment of ion exchange resin microspheres with boron-containing solutions. Since boron is not adsorbed appreciably on cation exchange resins from boric acid solutions, a strongly basic anion resin or a boron-specific ion exchange resin can be used. A boron-specific ion exchange resin has been prepared by aminating a chloromethylated styrene-divinylbenzene copolymer with N-methylglucamine (*Industrial and Engineering Chemistry Product Research and Development*, Vol. 3, No. 4, December 1964, p.304). Using this type of resin, boric acid can be retained quantitatively.

Boron can also be adsorbed on a strongly basic anion exchange resin such as "Dowex" 21K or "Dowex" 1X10 from boric acid solutions. The boron-loaded anion resin microspheres can then be coked to form boron-loaded carbon microspheres having the desired boron content depending upon the choice of solution concentration loading conditions. Boron-loaded carbon microspheres containing approximately 5 wt. percent boron have been prepared using this method.

EXAMPLE II

Gadolinium-loaded carbon microspheres were made by contacting "Dowex" 50WX12 (100–200 mesh) cation exchange resin microspheres in the hydrogen-ion form with gadolinium nitrate solution with gentle, magnetic stirring for three days to attain equilibrium adsorption by the resin of the gadolinium in solution.

The gadolinium nitrate solution was prepared by dissolving gadolinium oxide in nitric acid.

The gadolinium-treated cation resin microspheres were filtered on a Buchner funnel, rinsed quickly with demineralized water to remove any residual gadolinium nitrate solution mother liquor from the surface of the resin microspheres, and air-dried for one-half hour. The filtered gadolinium nitrate solution had a specific gravity of 1.1756 and analyzed 13.98 gms gadolinium per liter. The gadolinium-treated resin microspheres were then oven-dried for 16 hours at 105°C. and coked in a high-temperature furnace by slowly heating to 900°C. over a 60-hour heating-up period under a non-oxidizing, flowing nitrogen atmosphere. After coking, the gadolinium-loaded carbon microspheres analyzed 56.7 wt. percent gadolinium.

EXAMPLE III

Cadmium-loaded carbon microspheres were made by contacting "Dowex" 50WX12 (100–200 mesh) cation exchange resin microspheres in the hydrogen-ion form with cadmium nitrate solution with gentle, magnetic stirring for 3 days to attain equilibrium adsorption by the resin of the cadmium in solution. The cadmium nitrate solution was prepared by dissolving 200 gms cadmium nitrate crystals in 1 liter of demineralized water.

The cadmium-treated cation resin microspheres were filtered on a Buchner funnel, rinsed quickly with demineralized water to remove any residual cadmium nitrate solution mother liquor from the surface of the resin microspheres, and air-dried for one-half hour. The filtered cadmium nitrate solution had a specific gravity of 1.062 and analyzed 65.4 gms cadmium per liter. The cadmium-treated resin microspheres were oven-dried for 16 hours at 105°C. and coked in a high-temperature furnace by slowly heating to 900°C. over a 60-hour heating-up period under a non-oxidizing, flowing nitrogen atmosphere. After coking, the cadmium-loaded carbon microspheres analyzed 61.6 wt. percent cadmium.

EXAMPLE IV

Fifty grams of pyrophoric uranium metal powder was burned in a magnesium oxide crucible. Standard high-volume air monitoring equipment ("millipore" filter probe) was used to obtain an air intake volume of 17.5 liters per minute. In each of the tests, the alpha radioactivity was measured directly above the fire zone. When no extinguishing agent was used, 131 counts per minute of alpha radioactivity was detected above the burning 50-gram uranium specimen. In another test, fine graphite powder was applied to a 50-gram batch of burning uranium metal powder. After application of the fine graphite powder, 308 counts per minute of alpha radiation were detected. When carbon microspheres impregnated with 1.2 wt. percent boron were applied to 50 grams of burning uranium metal powder, 4 counts per minute of alpha radiation were detected. Under the same conditions, the subject microspheres reduced the airborne alpha radiation given off by the burning uranium metal powder from 131 counts to 4 counts per minute.

It is thus seen that the carbon microspheroid extinguishants of this invention provide an effective means for extinguishing metal fires as well as protection against criticality in fissionable metal fires.

What is claimed is:

1. A method for extinguishing a radioactive or fissionable metal fire comprising the step of placing carbon microspheroids on said fire, said microspheroids having as an impregnant a neutron absorber selected from the group consisting of boron, cadmium, and gadolinium.

2. The method according to claim 1 wherein said carbon is amorphous carbon.

3. The method according to claim 1 wherein said carbon is graphite.

4. The method according to claim 1 wherein said microspheroids have a major-to-minor axis ratio of less than 1.5.

5. The method according to claim 1 wherein said microspheroids have a radius within the range of 50 to 250 microns.

6. The method according to claim 1 wherein said absorber is boron in an amount of from 0.1 to 11.5 weight percent.

7. The method according to claim 1 wherein said absorber is cadmium in an amount of from 0.1 to 62.0 weight percent.

8. The method according to claim 1 wherein said absorber is gadolinium in an amount of from 0.1 to 57.0 weight percent.

9. The method according to claim 1 wherein said absorber is a mixture of boron, cadmium, and gadolinium.

* * * * *